United States Patent [19]

Cucchetti et al.

[11] Patent Number: 4,480,584

[45] Date of Patent: Nov. 6, 1984

[54] DEVICE ADAPTED TO APPLY THERMOPLASTIC CEMENT PARTICULARLY FOR ASSEMBLING SHOE VAMP SIDES

[75] Inventors: Celeste Cucchetti; Pietro Cucchetti, both of Vigevano, Italy

[73] Assignee: O.R.M.A.C. S.p.A. dei F.LLI CUCCHETTI & CO., Vigevano, Italy

[21] Appl. No.: 558,623

[22] Filed: Dec. 6, 1983

[30] Foreign Application Priority Data

Dec. 24, 1982 [IT] Italy ..... 23798/82[U]

[51] Int. Cl.[3] ..... B05C 5/02

[52] U.S. Cl. ..... 118/411; 118/242

[58] Field of Search ..... 118/410, 411, 412, 408, 118/242

[56] References Cited

U.S. PATENT DOCUMENTS 3,931,788 1/1976 Gadd et al. ..... 118/411 X

FOREIGN PATENT DOCUMENTS 1297122 11/1972 United Kingdom ..... 118/411

*Primary Examiner*—John P. McIntosh

*Attorney, Agent, or Firm*—Laff, Whitesel, Conte & Saret

[57] ABSTRACT

The invention pertains to a device adapted to apply thermoplastic cement for assembling shoe vamp sides, comprising a pair of heater units leading to feet suitable to spread cement along the edges of a shoe insole and a pair of supporting arms for said heater units fixedly mounted with respect to each other and connected to each other at their free ends by means of a pin, operated by an actuator, which can be disposed at a predetermined height above the insole. Each of said heater units is provided with a slide bar disposed parallelly to the axis thereof, axially and slidably engaged within a slide hole obtained in a small block carried by said supporting arms.

4 Claims, 1 Drawing Figure

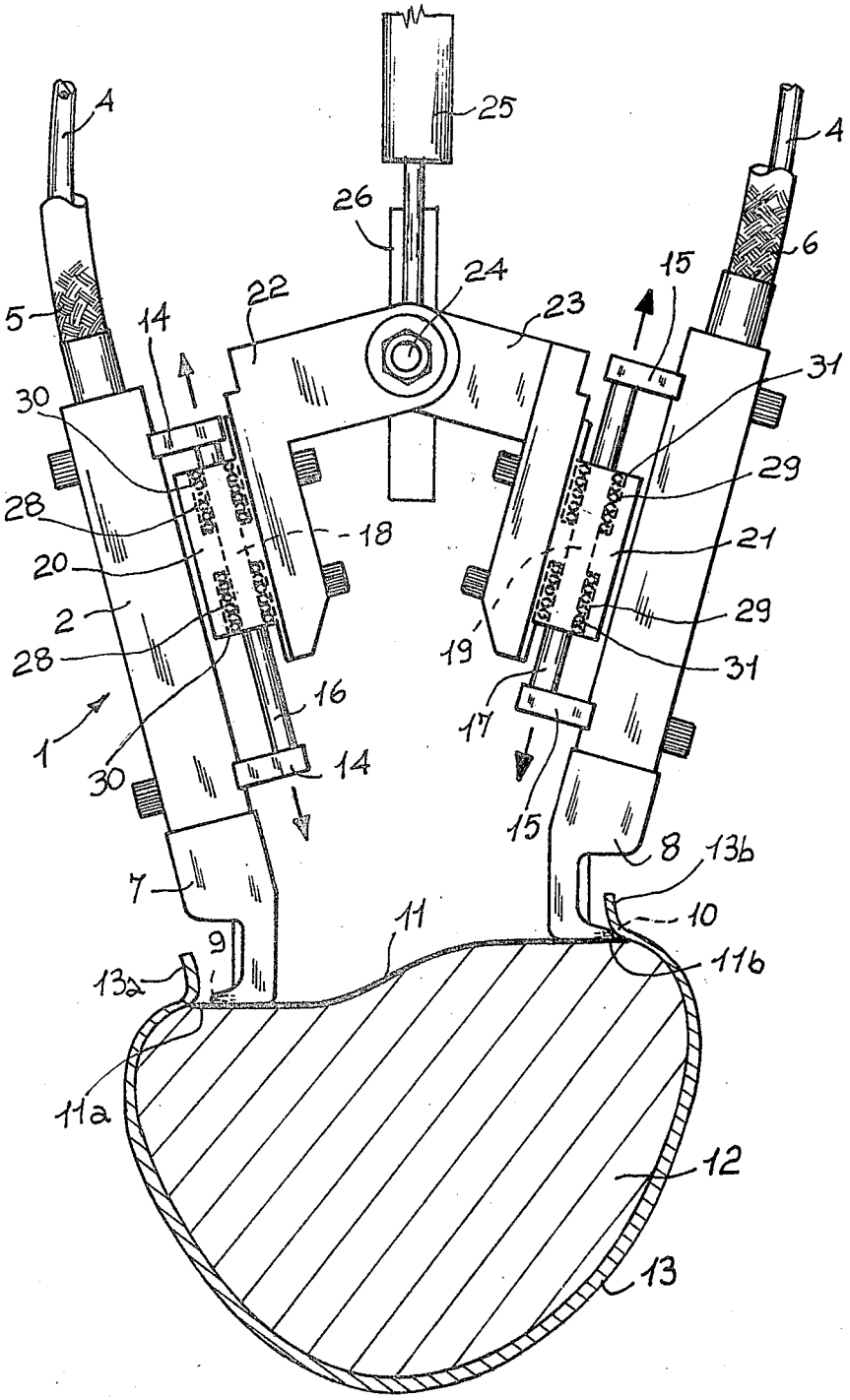
4
25
4
26
6
24
15
5
14
22
23
31
30
29
28
18
21
20
2
29
28
19
31
16
17
1
30
14
15
8
13b
7
10
11
9
11b
13a
11a
12
13

DEVICE ADAPTED TO APPLY THERMOPLASTIC CEMENT PARTICULARLY FOR ASSEMBLING SHOE VAMP SIDES

FIELD OF THE INVENTION

The present invention pertains to a device adapted to apply thermoplastic cement particularly for assembling shoe vamp sides.

The above device, however, is not only intended for use on shoe making machines but it can be generally utilized in all cases in which the use of a thermoplastic thread as a bonding agent is required and in which the cement must be applied following particularly shaped outlines.

BACKGROUND OF THE INVENTION

At present, in the field of the shoe factory machines that execute the pre-lasting and lasting of shoes, the cementing of the vamp sides to the insole is carried out by means of particular devices for applying thermoplastic cement.

These devices of the known type substantially consist of sensing and cement-applying feet under which the insole along the perimeter edge of which cement must be spread, is advanced.

Said cement-applying feet are fastened to the base of heater units adapted to fluidize a thermoplastic thread which is caused to pass therethrough. These units, together with their respective cement-applying feet, are mounted by pairs on the pre-lasting and lasting machines and are supported by arms that are reciprocally connected to each other at one end thereof by means of a pin, so that they can be independent in their respective movements. In this way, when an insole shaped on a last is caused to pass under said feet, the application of cement takes place uniformly as feet follow the differences in height of the last and always contact the insole. In practical applications, however, it often happens that, when the difference in height between one part of the last and the other is remarkable, for example in the case of woman shoes, this continuity of contact between the cement-applying feet and the insole ceases and, as a result, there is an irregular delivery of thermoplastic cement. More particularly, while the contact between the insole and the foot is always constant on the higher part of the last and therefore the delivery of cement can take place regularly, on the lower part the contact between the foot and the insole is not continuous and therefore along this part some areas will have an overamount of cement and other areas an insufficient amount thereof or even no cement at all.

OBJECTS

The main object of the present invention is to obviate the above mentioned drawbacks by the accomplishment of a device adapted to apply thermoplastic cement particularly for the assembling of shoe vamp sides which is suitable to keep the cement-applying feet always in contact with the insole edges, independently of the type of last used for obtaining the desired shoe, be it a woman or man shoe last, so that the cement can be evenly spread on every point of the insole edge.

Within the scope of this main object, it is a particular object of the present invention to cause the cement-applying feet to be completely independent of each other so that they can sense and touch the insole shaped on the last even when the latter has marked differences in shape as in the case of woman shoes that may have even a 110 mm high heel.

SUMMARY OF THE INVENTION

These and yet further objects that will become more apparent in the following description are attained according to the present invention, by a device adapted to apply thermoplastic cement, particularly for assembling shoe vamp sides, of the kind comprising a pair of heater units through which a thermoplastic thread is caused to pass and leading to respective cement-applying feet intended to spread a cement coat on the edges of a shoe insole and a pair of supporting arms for said heater units connected to each other at their free ends by means of a pin, characterized in that each of said heater units is provided with a slide bar which is disposed parallelly to the axis of its own heater unit and is slidably and axially engaged within a slide hole obtained in a small block carried by the corresponding supporting arm of the heater unit, said supporting arms being fixedly mounted with respect to each other on a pin that can be disposed at a predetermined height above the insole on which said cement must be spread.

Preferably and according to a further feature of the present invention, ball bearings are located in said holes through which the slide bars of the heater units slide, said ball bearings being suitable to assist the sliding of said bars.

Further features and advantages of the invention will become more evident from the detailed description of a preferred but not limiting embodiment of a device adapted to apply thermoplastic cement particularly for assembling shoe vamp sides, given hereinafter by way of example only, with reference to the accompanying drawing.

BRIEF DESCRIPTION OF THE DRAWING

The unique FIGURE is a front view of the device according to the invention.

DESCRIPTION OF THE PREFERRED EMBODIMENT

With reference to the drawing, it has been generally indicated at 1 a device adapted to apply thermoplastic cement particularly for assembling shoe vamp sides.

This device comprises a pair of heater units 2 and 3 through which a thermoplastic thread 4 is caused to pass, being supplied through flexible channels 5 and 6 so that it can be fluidized for the purpose of being converted to thermoplastic cement.

At their lower portions the heater units 2 and 3 lead to corresponding sensing and cement-applying feet 7 and 8 provided with nozzles 9 and 10 through which the cement to be spread along the edges 11*a*–11*b* of an insole 11 flows.

As it is possible to see from the sectioned part of the drawing, the insole 11 is shaped on a last 12 around which is disposed a vamp 13 to be cemented to the insole along the edges 13*a* and 13*b* thereof.

According to the invention, the heater units 2 and 3 are rigidly connected by means of connecting plates 14 and 15 to corresponding slide bars 16 and 17 disposed parallelly to the heater units. The slide bars 16 and 17 are engaged into holes 18 and 19 obtained in small blocks 20 and 21 that are fixedly mounted on the supporting arms 22 and 23 of the heater units 2 and 3.

Arms 22 and 23 are mounted, at one end thereof, on a central pin 24 suitable to slide in a vertical direction, operated by an actuator 25 within a groove 26 obtained in the machine casing. Actuator 25 is arranged so that it allows the device 1 to approach the region where it is intended to act. More particularly, the actuator 25 stops when the feet 7 and 8 contact the insole 11, on the edges 11*a* and 11*b* of which a coat of cement must be spread.

Advantageously, housings 28 and 29 are provided in holes 18 and 19 obtained in the small blocks 20 and 21, for accommodating corresponding ball bearings or self-lubricating bushings 30 and 31, designed to facilitate the sliding of rods 16 and 17 according to the shape of the last.

Operation

From what described above particularly with reference to its structure, the operation of the device adapted to apply thermoplastic cement according to the invention appears already clear.

First the actuator 25 is operated so that, as previously said, the device is brought to an operating suitable position and the insole 11 and vamp 13 are shaped on the required shoe last.

The stretching of vamp 13 and the standing of the sides 13*a* and 13*b* thereof are automatically executed by additional devices attached to the shoe pre-lasting and lasting machine on which the above described cement-applying device is mounted. However, these operations and devices are not described and shown here as they are not part of the present invention.

Once the above described arrangement has been achieved, the device 1 is caused to advance, by known and conventional means, above last 12 and insole 11, its advancing direction being at right angles to the drawing plane.

By effect of their own weight, feet 7 and 8 are kept closely in contact with the insole and can spread the desired amount of thermoplastic cement at a constant rate on both edges 11*a* and 11*b* of the insole 11.

The device attains therefore the intended objects, that is the achievement of an efficient spreading of cement along the insole edges, independently of the fact that the shoe last has a particularly shaped outline or not, be it a man, woman or child shoe last.

As the slide bars 16 and 17 can freely slide within the holes 18 and 19 of the small blocks 20 and 21, they allow feet 8 and 9 to raise and lower very easily according to the development of the last, and prevent them from interrupting the contact with the insole 11.

Obviously several modifications and variations can be made to the structure of the above described device without departing from the spirit and scope of the invention.

What is claimed is:

1. A device adapted to apply thermoplastic cement particularly for the assembling of shoe vamp sides, of the kind comprising a pair of heater units through which a thermoplastic thread is caused to pass and leading to respective cement-applying feet intended to spread a cement coat on the edges of a shoe insole and a pair of supporting arms for said heater units connected to each other at their free ends by means of a pin, characterized in that each of said heater units is provided with a slide bar which is disposed parallelly to the axis of its own heater unit and is slidably and axially engaged within a slide hole obtained in a small block carried by the corresponding supporting arm of the heater unit, said supporting arms being fixedly mounted with respect to each other on a pin that can be disposed at a predetermined height above the insole on which said cement must be spread.

2. A device according to claim 1, characterized in that ball bearings are located in said holes through which the slide bars of the heater units slide, said ball bearings being suitable to assist the sliding of said bars.

3. A device according to claim 1, characterized in that self-lubricating bushings or the like are located in said holes through which the slide bars of the heater units slide.

4. A device according to claim 1, characterized in that said pin is operated by an actuator on its movements close to and away from the operating area.

* * * * *